US007007489B2

(12) United States Patent
Schulten

(10) Patent No.: US 7,007,489 B2
(45) Date of Patent: Mar. 7, 2006

(54) GAS TURBINE

(75) Inventor: Wilhelm Schulten, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 146 days.

(21) Appl. No.: 10/719,958

(22) Filed: Nov. 21, 2003

(65) Prior Publication Data

US 2005/0000229 A1 Jan. 6, 2005

(30) Foreign Application Priority Data

Dec. 10, 2002 (EP) ..... 02027495

(51) Int. Cl.
*F23R 3/60* (2006.01)

(52) U.S. Cl. ..... 60/796; 60/752; 60/800

(58) Field of Classification Search ..... 60/752, 60/753, 796, 798, 800
See application file for complete search history.

(56) References Cited

U.S. PATENT DOCUMENTS 4,158,949 A 6/1979 Reider
5,083,424 A * 1/1992 Becker ..... 60/796

FOREIGN PATENT DOCUMENTS

| | | |
|---|---|---|
| DE | 41 14 768 A1 | 11/1991 |
| DE | 196 43 715 A1 | 4/1998 |
| DE | 198 09 568 A1 | 8/1999 |

* cited by examiner

*Primary Examiner*—Louis J. Casaregola (57)

ABSTRACT

In a gas turbine (1) with an annular combustion chamber (4), the combustion area (24) of which is bounded by an annular combustion chamber outer wall (26) on the one hand and by an annular combustion chamber inner wall (28) located therein on the other hand, it should be possible to dismantle the combustion chamber inner wall (28) comparatively quickly and easily. For this purpose according to the invention the combustion chamber inner wall (28) is formed by a plurality of wall elements attached to a support structure, wherein the support structure is formed by a plurality of sub-components abutting each other at a horizontal parting joint and the abutting sub-components (30) of the combustion chamber inner wall (28) are connected to each other at their horizontal parting joint by means of a plurality of screw connections (32) oriented at an angle to the inner wall surface.

20 Claims, 5 Drawing Sheets

GAS TURBINE

CROSS REFERENCE TO RELATED APPLICATIONS

This application claims priority of the European application No. 02027495.7 EP, filed Dec. 10, 2002 under the European Patent Convention and which is incorporated by reference herein in its entirety.

FIELD OF INVENTION

The invention relates to a gas turbine with an annular combustion chamber, the combustion area of which is bounded by an annular outer wall on the one hand and an annular inner wall located therein on the other hand.

BACKGROUND OF INVENTION

Gas turbines are used in many fields to drive generators or machines. The energy content of a fuel is thereby used to generate a rotational movement of a turbine shaft. For this purpose the fuel is burned in a plurality of burners, with compressed air being supplied by an air compressor. Combustion of the fuel produces a high-temperature working medium at high pressure. This working medium is directed into a turbine unit connected downstream from the respective burner, where it expands in a manner that provides work output. A separate combustion chamber can be assigned here to each burner, whereby the working medium flowing out of the combustion chambers can be combined before or in the turbine unit. Alternatively the gas turbine can however also be designed as what is known as an annular combustion chamber, with which a majority, in particular all, of the burners open out into a common, generally annular, combustion chamber.

When designing such gas turbines, both the achievable output and a particularly high level of efficiency are generally the design objectives. An increase in efficiency can essentially be achieved for thermodynamic reasons by increasing the exit temperature at which the working medium flows out of the combustion chamber and into the turbine unit. Temperatures of around 1200° C. to 1500° C. are therefore aimed at and achieved for such gas turbines.

With such high working medium temperatures however the components and parts exposed to said medium are exposed to high thermal loads. In order to ensure a comparatively long life for the components in question, whilst nevertheless maintaining a high level of reliability, an embodiment comprising particularly heat-resistant materials is required as is cooling of the relevant components, such as the combustion chamber and the turbine unit. The combustion chamber and the moving parts of the turbine unit in particular are however subject to increased wear and tear due to the thermal load and general attrition due to the throughflow of the working medium, with the result that gas turbines have to be regularly maintained so that damaged components can be replaced or repaired.

The turbine unit adjacent to the combustion chamber in the direction of flow of the working medium generally comprises a turbine shaft which is connected to a plurality of rotatable blades which form series of blades in an overlapping ring shape. The turbine unit also comprises a plurality of fixed vanes, which are also attached in an overlapping ring shape to the inner housing of the turbine thereby forming series of vanes. The blades are used to drive the turbine shaft by transmitting the pulse from the working medium flowing through the turbine unit, while the vanes are used to direct the flow of the working medium between two consecutive series of blades or blade rings viewed in the direction of flow of the working medium in each instance.

As the rotational movement of the turbine shaft is generally used to drive the air compressor connected upstream from the combustion chamber, this is extended beyond the turbine unit, so that the turbine shaft is surrounded in a toroidal manner by the annular combustion chamber in the area of the annular combustion chamber connected upstream from the turbine.

The combustion area is thereby bounded by an annular outer wall on the one hand and an annular inner wall located therein on the other hand. The inner wall of the combustion chamber generally comprises two or more individual parts for this purpose, which are screwed together on their side facing the turbine shaft.

This annular combustion chamber structure however has some disadvantages, as the inner wall of the combustion chamber is not accessible for maintenance work. This means that for maintenance work on the inner wall, the upper parts of the compressor and turbine blade supports have to be dismantled so that the turbine shaft can be disassembled with the inner wall of the combustion chamber, thereby allowing access to said inner wall. Assembly work is therefore very labor- and time-intensive. The comparatively long downtime of the gas turbine means that downtime costs are incurred in addition to gas turbine assembly costs, resulting in comparatively very high overall costs for maintenance and repair work on the gas turbine.

SUMMARY OF INVENTION

The object of the invention is therefore to specify a gas turbine of the type mentioned above, wherein the inner wall of the combustion chamber can be dismantled comparatively quickly and easily.

This object is achieved according to the invention by forming the inner wall of the combustion chamber from a plurality of wall elements attached to a support structure of the inner wall, whereby the support structure is formed by a plurality of sub-components abutting each other at a horizontal parting joint which are connected to each other in the area of the parting joint via a plurality of screw connections oriented at an angle to the inner wall surface.

The wall elements hereby in particular form the surface of the combustion chamber subject to the hot gas, whereby the wall elements are expediently attached to the actual support structure of the inner wall. This support structure in particular also comprises an upper and a lower half which are connected to each other via the screw connections oriented at an angle to the parting joint plane.

The invention is based on the consideration that the attachment of the different wall elements of the combustion chamber inner wall to each other should be accessible from the combustion area and the combustion chamber inner wall should also be dismantled from here too. At the same time the different sub-components of the support structure assigned to the combustion chamber inner wall which abut each other at their horizontal parting joint should be connected to each other by means of an attachment which connects these to each other at the parting joint by a vertical force. These two functions are provided by the screw connections oriented at an angle to the inner wall surface which are accessible from the combustion chamber and also provide a sufficiently large force component to connect the two halves of the support structure.

In order to compensate for the resulting horizontal force component of two sub-components of the support structure connected to each other by the screw connection by means of the screw connection oriented at an angle to the inner wall, a key is expediently assigned to each screw connection. The key prevents the wall elements screwed to each other at the horizontal parting joint being moved towards each other by the horizontal force component of the screw connection. For this purpose the key advantageously runs along the horizontal parting joint and fits precisely in each instance into grooves in the abutting wall elements, so that these cannot move towards each other and preferably only the vertical force component of the screw connection required for the attachment of the screw connection occurs at the horizontal parting joint.

In order to maintain the accessibility of the inside of the combustion chamber and therefore the screw connections of the combustion chamber inner wall, the outer wall of the annular combustion chamber is advantageously implemented in two parts and formed by a lower part interacting with an upper part. The upper part is hereby expediently screwed to the lower part, so that the combustion chamber outer wall can be removed. With this type of combustion chamber outer wall structure, the combustion chamber inner wall and therefore also the screw connections of the combustion chamber inner wall elements are accessible.

In order to protect the combustion chamber wall from thermal loading by the working medium, the inner and outer walls of the combustion chamber are expediently fitted with a lining formed from a plurality of heat shield elements. These are preferably provided with particularly heat-resistant protective layers.

The heat shield elements are advantageously attached by means of a tongue and groove system to the inner wall and outer wall of the combustion chamber. The edges of the heat shield elements are hereby preferably formed so that they are bent twice towards the combustion chamber to form an anchorage and they anchor themselves in a recess in the combustion chamber wall which forms the groove, thereby becoming attached. Expediently the recess in the combustion chamber wall serves adjacent heat shield elements, so that adjacent heat shield elements abut each other with their front faces resulting from bending, thereby forming a seal for the combustion chamber and the working medium flowing therein.

The advantages achieved with the invention in particular comprise the fact that the parting joint screw connection of the combustion chamber walls allows comparatively easy and fast assembly of the combustion chamber walls. The possibility in particular of removing the inner wall of the combustion chamber allows faster and better maintenance of these combustion chamber parts. Time-consuming removal of the blades and vanes used in the further operation of the turbine unit is therefore not necessary as access is possible from the inside of the combustion chamber, so maintenance work can be carried out comparatively easily and quickly.

BRIEF DESCRIPTION OF THE DRAWINGS

An exemplary embodiment is described in more detail with reference to a drawing, in which.

The same parts are assigned the same reference numbers in all the figures.

DETAILED DESCRIPTION OF INVENTION

Figure 1:
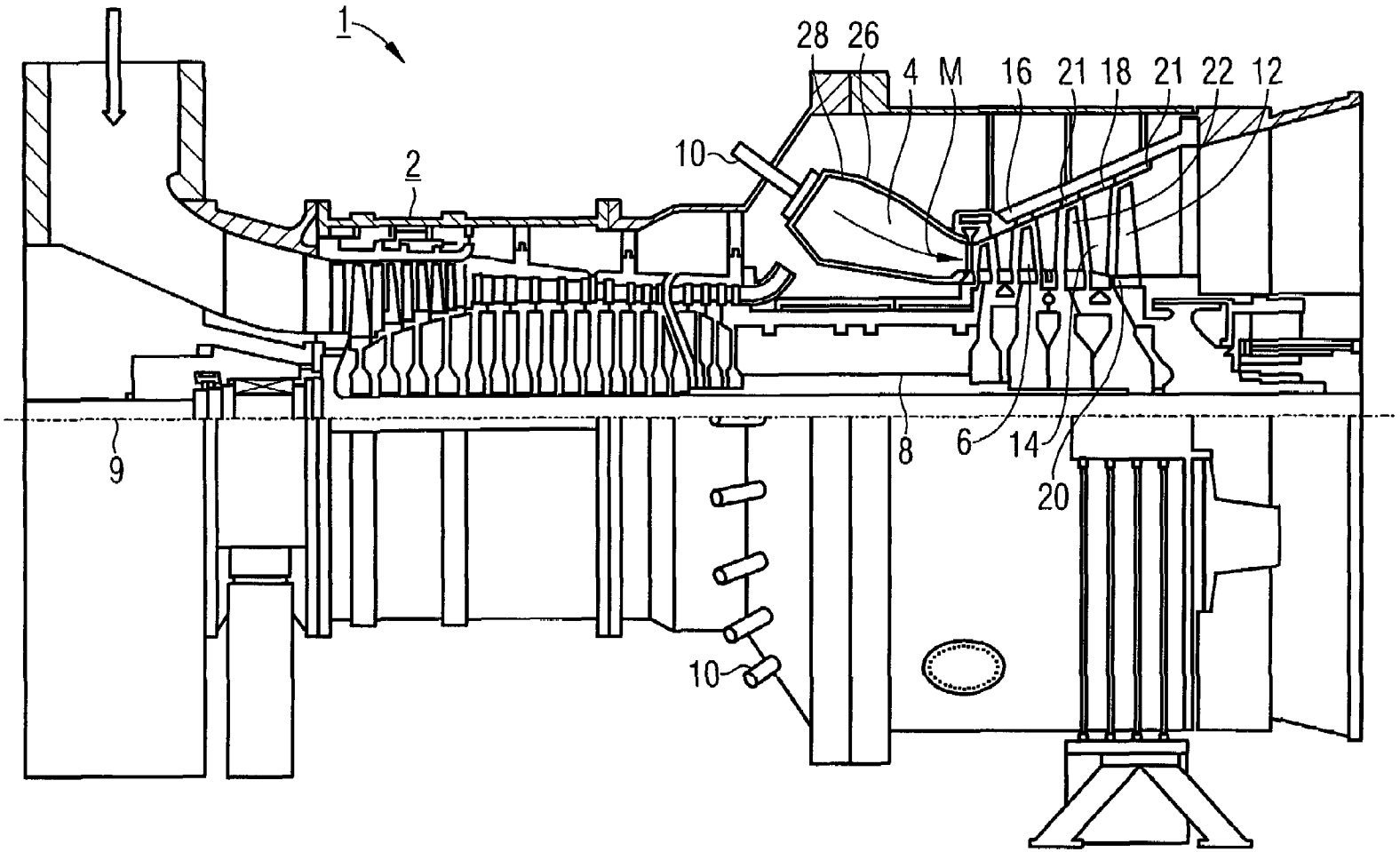
FIG. 1 shows a half-section through a gas turbine.

The gas turbine 1 according to FIG. 1 has a compressor 2 for combustion air, a combustion chamber 4 and a turbine 6 to drive the compressor 2 and a generator or machine (not shown). The turbine 6 and the compressor 2 are also arranged on a common turbine shaft 8 also referred to as the turbine rotor, to which the generator or machine is also connected, and which is positioned so that it can be rotated about its central axis 9. The combustion chamber 4 configured as an annular combustion chamber is fitted with a plurality of burners 10 to burn a liquid or gaseous fuel.

The turbine 6 has a plurality of rotatable blades 12 connected to the turbine shaft 8. The blades 12 are arranged in an overlapping ring shape on the turbine shaft 8, thereby forming a plurality of series of blades. The turbine 6 also has a plurality of fixed vanes 14 which are also attached in an overlapping ring shape on an inner housing 16 of the turbine 6 to form series of vanes. The blades 12 are hereby used to drive the turbine shaft 8 by transmitting the pulse from the working medium M flowing through the turbine 6. The vanes 14 on the other hand are used to direct the flow of the working medium M between two consecutive series of blades or blade rings viewed in the direction of flow of the working medium M in each instance. A consecutive pair of a ring of vanes 14 or a series of vanes and a ring of blades 12 or a series of blades is hereby also referred to as a turbine stage.

Each vane 14 has a platform 18, also referred to as a vane root, which is arranged as a wall element on the inner housing 16 of the turbine 6 to attach the respective vane 14. The platform 18 is hereby a component subject to a comparatively high level of thermal loading which forms the outer boundary of a hot gas channel for the working medium M flowing through the turbine 6. Each blade 12 is similarly attached to the turbine shaft 8 via a platform 20, also referred to as a blade root.

A guide ring 21 is arranged on the inner housing 16 of the turbine 6 between each of the separated platforms 18 of the vanes 14 of two adjacent series of vanes. The outer surface of each guide ring 21 is thereby also exposed to the hot working medium M flowing through the turbine 6 and separated from the outer end 22 of the opposite blade 12 by a gap in the radial direction. The guide rings 12 arranged between adjacent series of vanes are hereby used in particular as cover elements which protect the inner wall 16 or other integral housing parts from thermal overload by the hot working medium M flowing through the turbine 6.

The combustion chamber 4 in the exemplary embodiment is designed as what is known as an annular combustion chamber, wherein a plurality of burners 10 arranged in the circumferential direction around the turbine shaft 8 open out into a common combustion chamber area. The combustion chamber 4 is also implemented in its entirety as an annular structure which is positioned around the turbine shaft 8.

Figure 2:
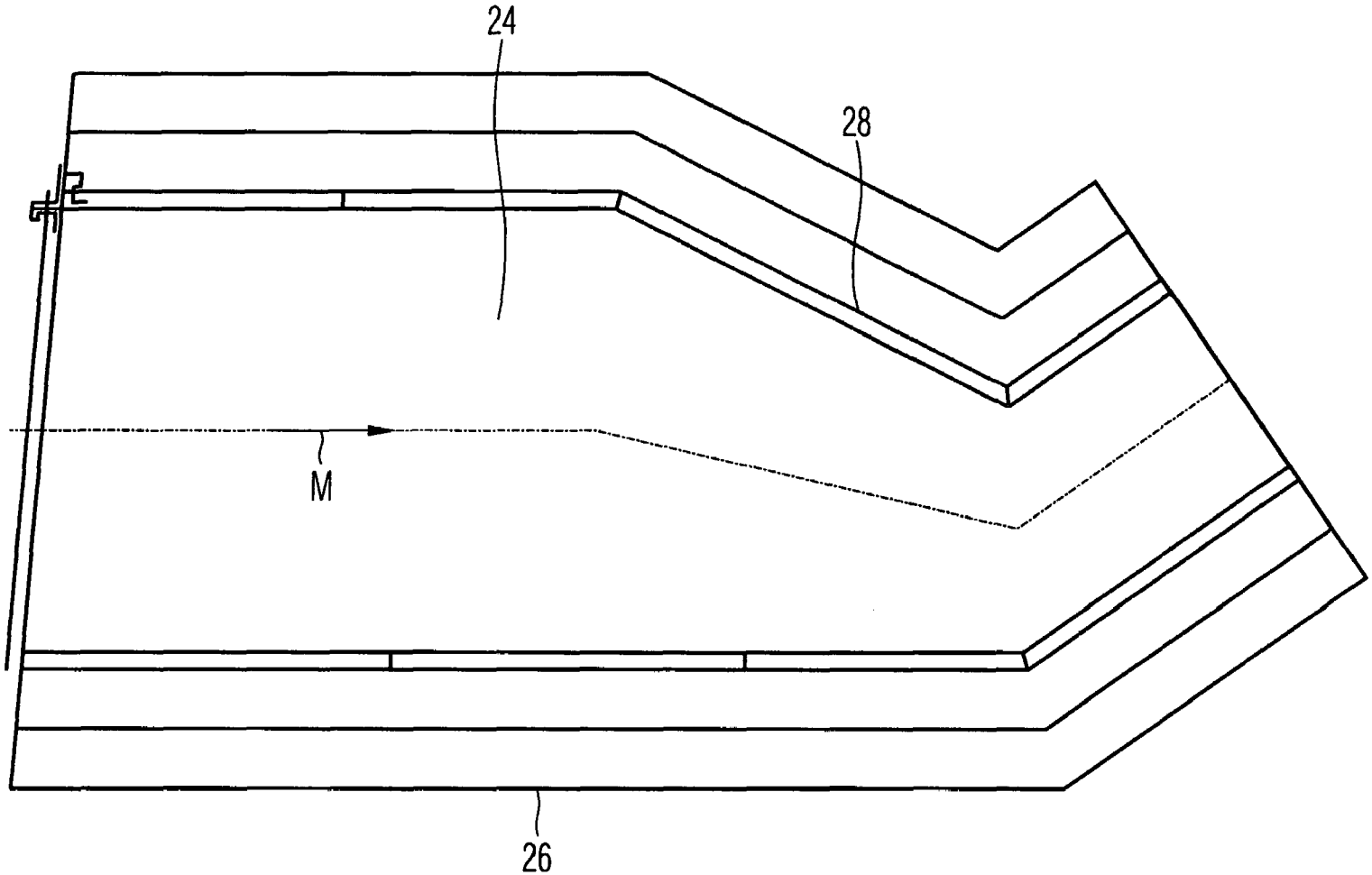
FIG. 2 shows a section through an annular combustion chamber.

To clarify the embodiment of the combustion chamber 4 further, in FIG. 2 the combustion chamber 4 is shown in cross-section as it continues in a toroidal manner around the turbine shaft 8. As shown in the diagram, the combustion chamber 4 has an initial or inflow section into which the end of the outlet of the respectively assigned burner 10 opens. Viewed in the direction of flow of the working medium M, the cross-section of the combustion chamber 4 then narrows, with account being taken of the changing flow profile of the working medium M in this area. On the outlet side, the combustion chamber 4 exhibits in its longitudinal cross-section a curve which favors the outward flow of the working medium M from the combustion chamber 4 resulting in a particularly high pulse and energy transmission to the next series of blades seen from the flow side.

Figure 3:
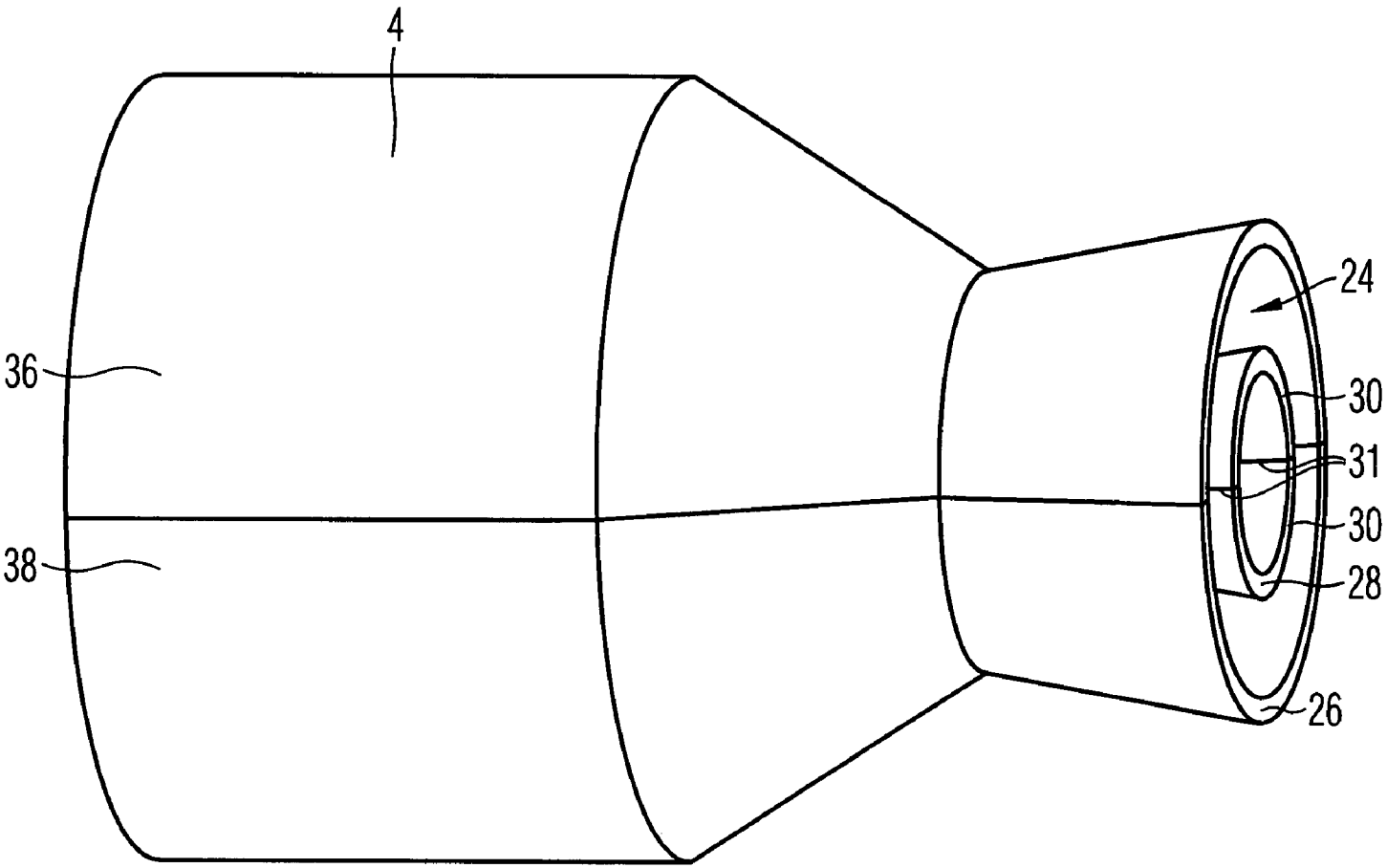
FIG. 3 shows a side view of the annular combustion chamber.

As shown in the diagram according to FIG. 3, the combustion area 24 of the combustion chamber 4 is bounded by the annular combustion chamber outer wall 26 on the one hand and by an annular combustion chamber inner wall 28 located therein on the other hand. The combustion chamber 4 is designed so that the combustion chamber inner wall 28 can be removed particularly easily for maintenance work for example, without having to dismantle the turbine shaft 8 and the upper part of the vanes 16 of the turbine 6 directly adjacent to the combustion chamber 4. The combustion chamber inner wall 28 also comprises a plurality of wall elements which are attached to two sub-components 30 of a support structure, whereby the sub-components 30 are combined with the combustion chamber inner wall 28 to form an essentially horizontal parting joint 31.

Figure 4:
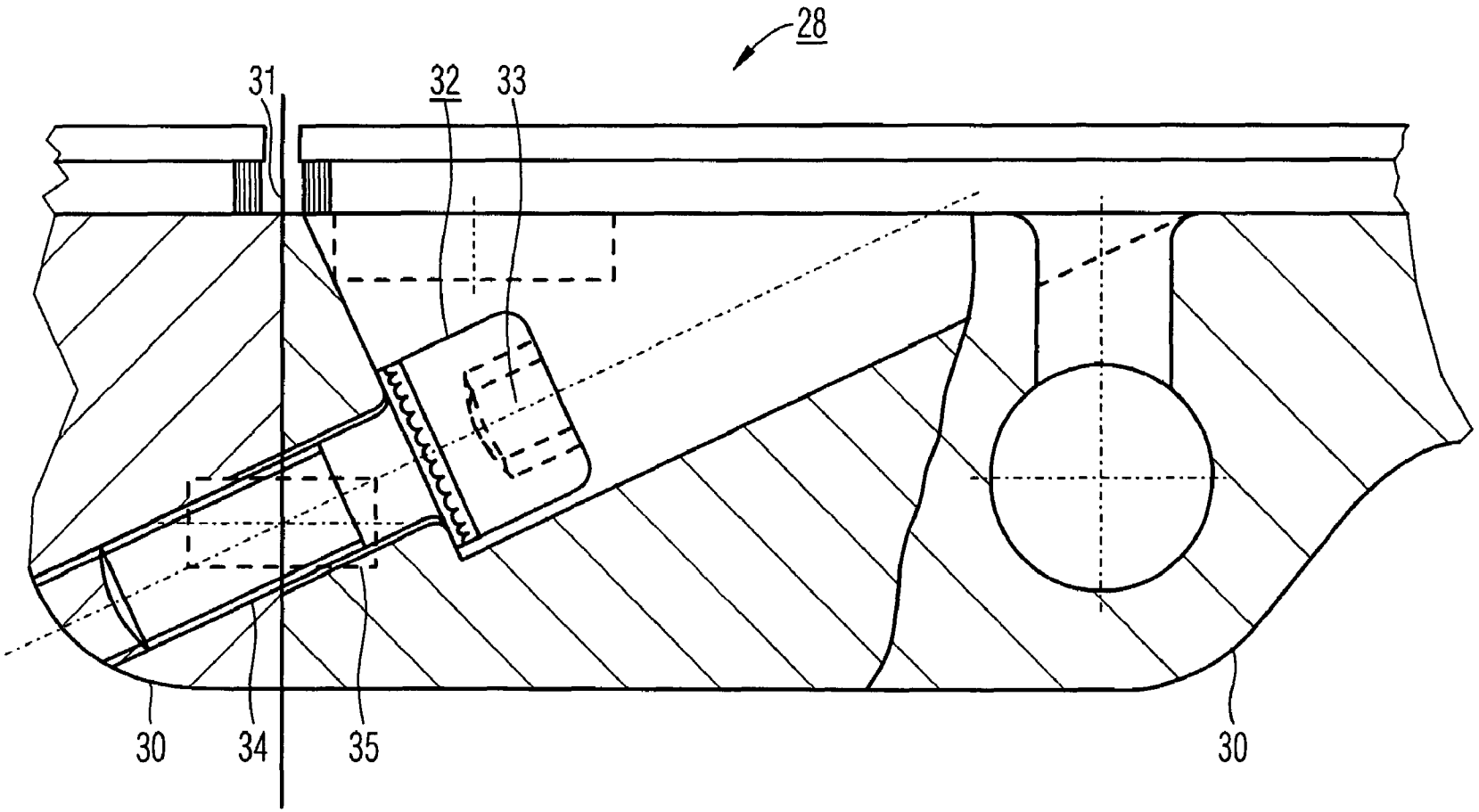
FIG. 4 shows a sectional view of a screw connection of the wall elements of the combustion chamber inner wall.

The combustion chamber 4 is also designed in particular so that the wall elements and the sub-components 30 of the combustion chamber inner wall 28 supporting these can be dismantled from the combustion area 24. As shown in cross-section in FIG. 4, the sub-components 30 are connected for this purpose to the horizontal parting joint 31 formed by them by screw connections 32 oriented at an angle to the inner surface of the combustion chamber inner wall 28. Each screw connection 32 hereby comprises a screw 33 essentially directed at an angle to the surface formed by the combustion chamber inner wall 28, said screw interacting with a thread 34 incorporated in one of the wall elements 30.

So that the sub-components 30 do not move towards each other due to the horizontal force component resulting from the screws 33 disposed at an angle to the combustion chamber inner wall 28, a key 35 is assigned to the screw connection 32. This is located in a position close to the respective screw connection 32 along the horizontal parting joint 31 of the sub-components 30 and fits into grooves in the sub-components 30 of the combustion chamber inner wall 28.

To facilitate access to the combustion area 24 of the combustion chamber 4, the combustion chamber outer wall 26 comprises an upper part 36 and a lower part 38, as shown in FIG. 3. The upper part 36 and the lower part 38 are provided for this purpose with screw connections perpendicular to the parting joint plane unlike the connection of the sub-components 30 of the support structure forming the combustion chamber inner wall 28, as there are no accessibility problems here.

Figure 5:
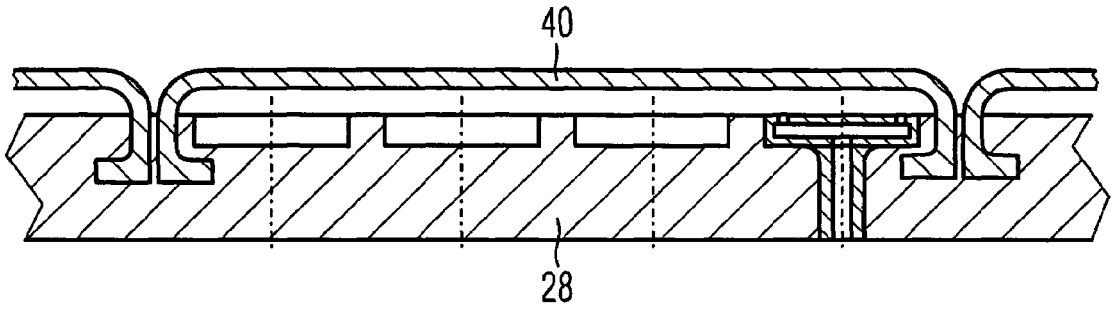
FIG. 5 shows a section of the combustion chamber inner wall.

To achieve a comparatively high level of efficiency, the combustion chamber 4 is designed for a comparatively high working medium M temperature of around 1200° C. to 1300° C. In order to achieve a comparatively long operating life even with such unfavorable operating parameters for the materials, as shown in FIG. 5 the combustion chamber outer wall 26 and the combustion chamber inner wall 28 are each provided with a lining made from heat shield elements 40 on their sides facing the working medium M. Each heat shield element 40 is given a particularly heat-resistant protective layer on the side facing the working medium M.

In the example of a combustion chamber inner wall 28 shown in FIG. 5, the heat shield elements 40 are attached by means of a tongue and groove system to the combustion chamber inner wall 28. For this purpose the edges of the heat shield elements 40 are formed so that they are bent twice towards the combustion chamber to form an anchorage and they anchor themselves in a recess in the combustion chamber inner wall 28 which forms the groove, thereby becoming attached. As can also be seen from FIG. 5, adjacent heat shield elements 40 are attached in such a way to joint grooves that they are in mutual contact and thus seal the combustion area 24 of the combustion chamber 4.

What is claimed is:

1. A gas turbine comprising:

a compressor for compressing air;

a combustion chamber operatively connected to the compressor, the combustion chamber having a combustion area bounded by an outer wall and an inner wall, the inner wall formed by a plurality of wall elements attached to a support structure of the inner wall, the support structure formed by a plurality of sub-components abutting at a horizontal parting joint, the sub-components connected to each other in the area of the parting joint via a plurality of screw connections oriented at a non perpendicular angle to the horizontal parting joint; and an airfoil section operatively connected to the combustion chamber.

2. The gas turbine according to claim 1, wherein a key is assigned to at least one screw connection.

3. The gas turbine according to claim 1, wherein the outer wall of the combustion chamber is formed in two parts.

4. A gas turbine comprising:

a compressor for compressing air;

a combustion chamber operatively connected to the compressor, the combustion chamber having a combustion area bounded by an outer wall and an inner wall, the inner wall formed by a plurality of wall elements attached to a support structure of the inner wall, the support structure formed by a plurality of sub-components abutting at a horizontal parting joint, the sub-components connected to each other in the area of the parting joint via a plurality of screw connections oriented at a angle to the inner wall surface; and an airfoil section operatively connected to the combustion chamber, wherein the inner wall and/or the outer wall is fitted with a lining formed by a plurality of heat shield elements.

5. The gas turbine according to claim 2, wherein the outer wall is formed in two parts.

6. The gas turbine according to claim 2, wherein the inner wall and/or the outer wall is fitted with a lining formed by a plurality of heat shield elements.

7. The gas turbine according to claim 3, wherein the inner wall and/or the outer wall is fitted with a lining formed by a plurality of heat shield elements.

8. The gas turbine according to claim 6, wherein the heat shield elements are attached to the inner wall or the outer wall by means of a tongue and groove system.

9. The gas turbine according to claim 7, wherein the heat shield elements are attached to the inner wall or the outer wail by means of a tongue and groove system.

10. The gas turbine according to claim 1, wherein the combustion chamber is an annular combustion chamber.

11. The gas turbine according to claim 1, wherein the sub-components abut each other.

12. The gas turbine according to claim 1, wherein the airfoil section is operatively adapted to turn a shaft.

13. The gas turbine according to claim 1, wherein the airfoil section is operatively adapted to drive the compressor or a generator.

14. The gas turbine according to claim 3, wherein a lower part interacts with an upper part.

15. The gas turbine according to claim 5, wherein a lower part interacts with an upper part.

16. A combustion chamber comprising:

a plurality of burners to burn a fuel;

an outer wall;

inner wall; and a combustion area bounded by the outer wall and the inner wall, the inner wall formed by a plurality of wall elements attached to a support structure of the inner wall, and the support structure formed by a plurality of abutting sub-components, the sub-components connected to each other in the area of a parting joint via a plurality of screw connections, at least one key assigned to the screw connection and the screw connections oriented at an angle to the inner wall surface.

17. The combustion chamber according to claim 16, wherein the combustion chamber is an annular combustion chamber.

18. The gas turbine according to claim 1, wherein the inner wall and/or the outer wall is fitted with a lining formed by a plurality of heat shield elements.

19. The gas turbine according to claim 1, wherein the non-perpendicular angle is approximately 45 degrees.

20. The gas turbine according to claim 18, wherein the heat shield elements are attached to the inner wall or the outer wall by a tongue and groove system.

* * * * *